US007114271B2

(12) United States Patent
Chagnot et al.

(10) Patent No.: US 7,114,271 B2
(45) Date of Patent: Oct. 3, 2006

(54) CUTTING TOOL FOR DIGGING TRENCHES, AND ENABLING THE CUTTER HEAD TO BE CHANGED QUICKLY

(75) Inventors: Philippe Chagnot, Nanterre (FR); Fabrice Mathieu, Nanterre (FR)

(73) Assignee: Compagnie du Sol, Nanterre (FR)

( * ) Notice: Subject to any disclaimer, the term of this patent is extended or adjusted under 35 U.S.C. 154(b) by 0 days.

(21) Appl. No.: 10/865,162

(22) Filed: Jun. 9, 2004

(65) Prior Publication Data

US 2005/0000122 A1 Jan. 6, 2005

(30) Foreign Application Priority Data

Jun. 11, 2003 (FR) ..... 03 07028

(51) Int. Cl.
*E02F 5/08* (2006.01)

(52) U.S. Cl. ..... 37/352; 37/468

(58) Field of Classification Search ..... 37/189, 37/462, 352, 468; 299/106
See application file for complete search history.

(56) References Cited

U.S. PATENT DOCUMENTS

| | | | | |
|---|---|---|---|---|
| 2,637,527 | A * | 5/1953 | Andrews, Jr. | 175/94 |
| 2,801,479 | A * | 8/1957 | Brauer | 37/189 |
| 4,509,768 | A | 4/1985 | Haug | |
| 4,694,915 | A * | 9/1987 | Bauer et al. | 175/91 |
| 4,718,504 | A * | 1/1988 | Terashima et al. | 175/96 |
| 4,971,157 | A * | 11/1990 | Bollinger et al. | 175/103 |
| 5,035,071 | A * | 7/1991 | Stotzer et al. | 37/94 |
| 5,111,601 | A * | 5/1992 | Casagrande | 37/91 |
| 5,212,892 | A * | 5/1993 | Maitlen et al. | 37/329 |
| 5,666,794 | A | 9/1997 | Vought et al. | |
| 5,813,151 | A | 9/1998 | Stephens et al. | |
| 6,076,290 | A * | 6/2000 | Seitle et al. | 37/398 |
| 6,116,699 | A | 9/2000 | Kaczmarski et al. | |
| 6,193,444 | B1 * | 2/2001 | Jonninen | 405/258.1 |
| 6,247,757 | B1 | 6/2001 | Cochran | |
| 6,301,811 | B1 * | 10/2001 | Gilmore, Jr. | 37/468 |
| 6,438,874 | B1 * | 8/2002 | LaBounty et al. | 37/403 |
| 6,497,294 | B1 | 12/2002 | Vought | |
| 6,839,988 | B1 * | 1/2005 | Gessay et al. | 37/189 |

FOREIGN PATENT DOCUMENTS

| | | |
|---|---|---|
| EP | 0 496 926 | 8/1992 |
| FR | 2 819 834 | 7/2002 |

* cited by examiner

*Primary Examiner*—Victor Batson
(74) *Attorney, Agent, or Firm*—Merchant & Gould P.C.

(57) ABSTRACT

The invention relates to a cutting tool for digging vertical trenches, the tool comprising:

a jib (B);

a cutter structure (34; C) suspended from the jib via a cable;

a plurality of cutter members (18) disposed on at least one cylindrical surface;

a motor assembly (12);

power supply means (46) for powering said motor assembly (12).

releasable retention means (22; 44) for securing at least a portion of the motor assembly (12) having the cutter members (18) mounted thereto to the bottom end of the structure (34);

relative positioning means between the structure (34) and the motor assembly (12); and means for connecting the power supply means (46) to the motor assembly (12);

whereby at least a portion of the motor assembly (12) with the cutter members (18) can easily be separated from the structure (34) of the machine.

25 Claims, 4 Drawing Sheets

CUTTING TOOL FOR DIGGING TRENCHES, AND ENABLING THE CUTTER HEAD TO BE CHANGED QUICKLY

The present invention relates to a cutting tool for digging trenches.

When excavating trenches in the ground in order to make cast walls, it is known to use excavation machines often referred to as "cutters". They comprise a structure suspended from hoist means, the bottom end of the structure being provided with two wheels driven by hydraulic motors and carrying teeth that are distributed over two horizontal-axis drums. The function of the teeth is to excavate the ground by transforming it into lumps of small size which can subsequently be removed by suction using a hose connected to a suction pump located on the cutter.

Such a cutting or excavation tool is described in particular in European patent EP 0 262 050 in the name of the Applicant. The cutter is fitted with two wheels that turn in opposite directions, each wheel comprising two drums. As mentioned above, the wheels are rotated by a hydraulic motor or by two hydraulic motors positioned in the central hub of each wheel and disposed at the bottom end of the tool body. The drums carry teeth which are used for excavating the ground.

For each type of ground, it is necessary to use teeth that are adapted to the nature of the ground that is to be excavated. Depending on whether the ground is hard, soft, or sticky, the teeth that are appropriate for use, and their positions on the drums, are different. French patent FR 2 819 834 describes, for example, the shapes and the positioning of teeth for use in ground that is hard or ground that is sticky.

During excavation, the teeth are subjected to very high mechanical forces, so they must be secured very strongly to the drums.

In general, the ground to be dug comprises superposed layers of rocks of different kinds and hardnesses. Thus, during an excavation operation, it is possible that the cutter needs to pass in alternation through layers of loose rock and through layers that are very hard. The problem which then arises lies in selecting an appropriate type of teeth. As mentioned above, each type of ground corresponds to a matching type of teeth. As a result, it would be particularly advantageous to be able to change the type of teeth during a given excavation operation in order to adapt the cutter to the ground.

A first solution would be to remove the drums on which the teeth are fixed and then install other drums having some other type of teeth fixed thereto. Although that can be done, that solution presents numerous drawbacks. As mentioned, the teeth are secured strongly, so successive operations of removing and reinstalling drums are lengthy, difficult, and dangerous. Another drawback is the time wasted by the users of the cutter which implies additional costs to be expended for any given excavation operation.

The present invention seeks to solve this problem by proposing a device that is simple, modular, and inexpensive.

This object is achieved by the fact that the cutting tool comprises:

a jib;

a cutter structure suspended from the jib via a cable;

a plurality of cutter members disposed on at least one cylindrical surface;

a motor assembly;

power supply means for powering said motor assembly;

releasable retention means for securing at least a portion of the motor assembly having the cutter members mounted thereto to the bottom end of the structure;

relative positioning means between the structure and the motor assembly; and means for connecting the power supply means to the motor assembly;

whereby at least a portion of the motor assembly with the cutter members can easily be separated from the structure of the machine.

It will be understood that by means of the dispositions of the invention, it is particularly simple and quick to adapt the drilling teeth to the ground that is to be excavated by means of a simple and quick change of the cutter head which comprises simultaneously the drums with the teeth and the motors and/or the torque transmission system such as a gearbox. The releasable retention means and the positioning means ensure that the cutting tool is rigid and strong during the excavation operation.

Advantageously, the motor assembly is a motor having the cutter members mounted thereon. It will be understood that when changing the cutter head, the removable portion includes the motors and the cutter members.

Advantageously, the cutting tool further includes suction means secured to the structure, a suction nozzle that is removable with at least the portion of the motor assembly having the cutter members fixed thereon, and means for releasably connecting these two elements. It will be understood that the present invention provides connection means which enable the suction nozzle to be removed together with the cutter head.

Advantageously, the releasable retention means include a plate having at least the portion of the motor assembly that supports the cutter members mounted on the bottom face thereof. It will be understood that under such circumstances such a plate serves as a support simultaneously for the motor, the cutters, and also the suction nozzle.

Advantageously, the bottom end of the structure further includes a plate which comes to bear on the plate associated at least with said portion of the motor assembly that supports the cutter members. It will be understood that the advantage here lies in plane-on-plane thrust which confers the necessary stability while fixing the cutter head to the structure.

Advantageously, the relative positioning means and the retention means between the structure and at least a portion of the motor assembly comprise at least one fixing peg secured to the plate associated with at least the portion of the motor assembly that supports the cutter members. In this configuration, the pegs serve firstly to position the two plates properly relative to each other, secondly to prevent any relative movement between the two plates, and thirdly to secure the two plates to each other in a manner that is easily releasable.

Advantageously, the fixing peg includes a through orifice for receiving a locking member mounted on the structure. It will be understood that when the two plates are positioned one on the other and the pegs project therefrom, the corresponding orifices are free to receive locking members.

Advantageously, the locking member is a cotter-pin. A particularly effective embodiment for releasable connection is a locking system using pegs and cotter-pins. Each cotter-pin is positioned in the orifice of a peg projecting from the plate associated with the structure.

Advantageously, the plate associated with the structure is connected to the bottom end of the structure via a pivot system. It will be understood that in this configuration, the cutter head can be tilted relative to the structure. This provides a plurality of working positions corresponding to different angles of inclination.

The invention will be better understood and its advantages will appear better on reading the following detailed description of embodiments presented as non-limiting examples. The description refers to the accompanying drawings, in which.

Figure 2:
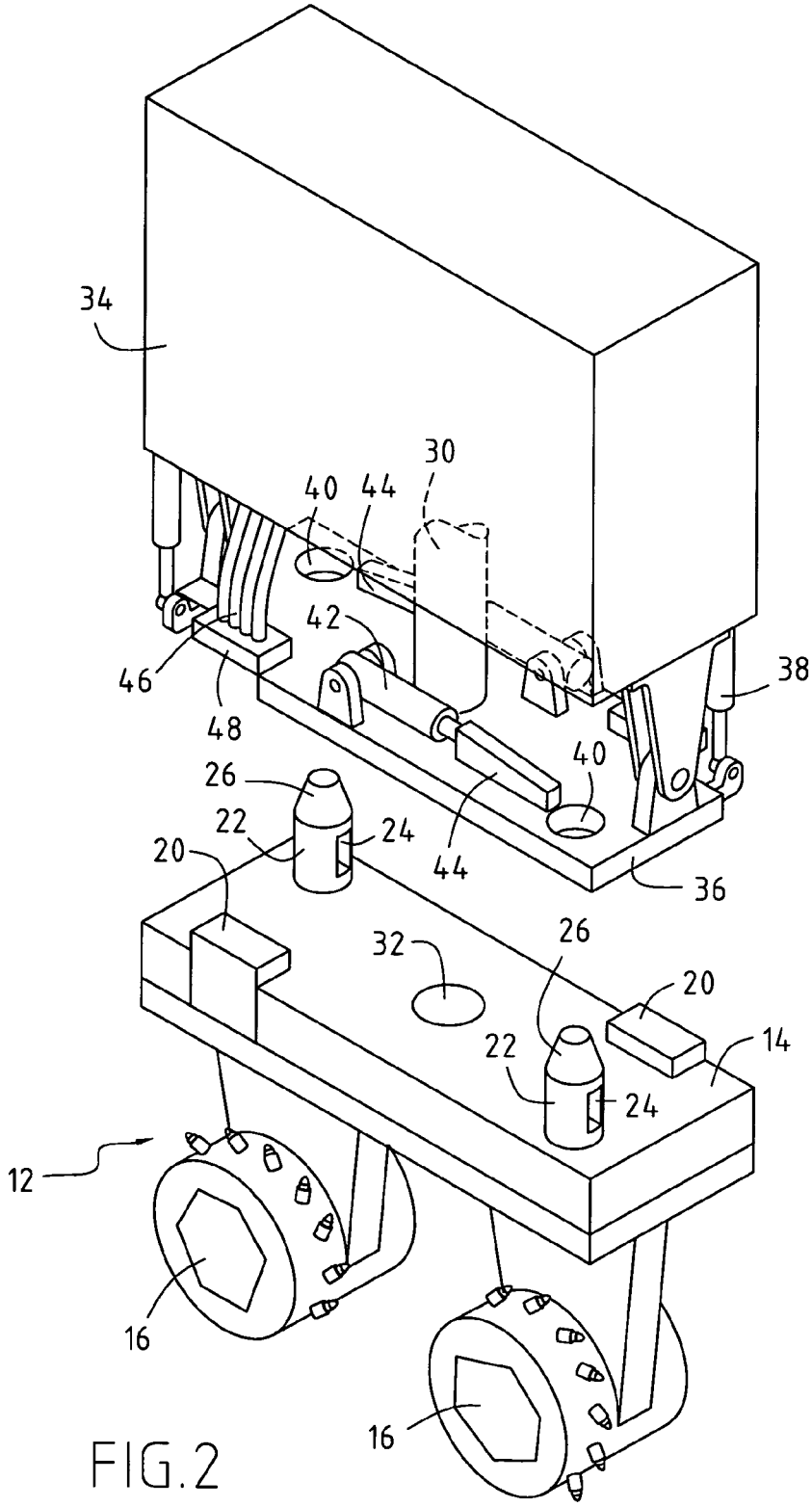
FIG. 2 is a perspective view of the cutter head separated from the structure.
Figure 3:
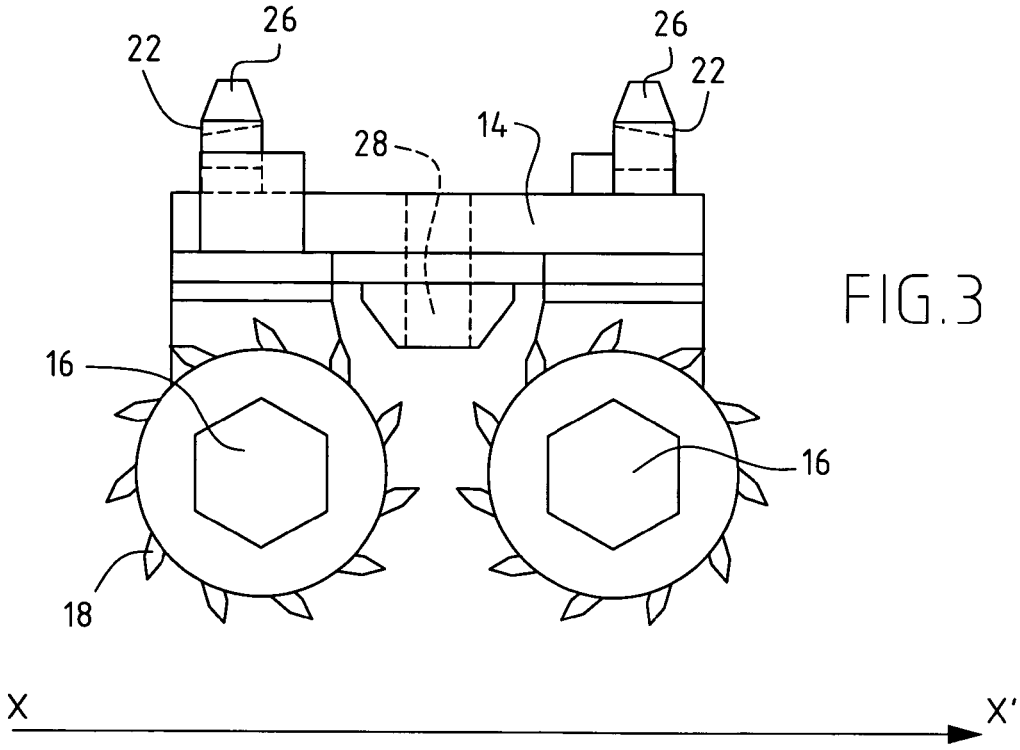
FIG. 3 is a front view of the cutter head.

FIGS. 2 and 3 show the cutter head 10 in the separated position. The motor assembly 12 comprises two hydraulic motors (not shown) rigidly secured to the bottom portion of a plate 14. Four cylindrical drums 16 constituted by shells are rotated by the motors via mechanical connection means (not shown). On their peripheries, the drums have cutter members 18 securely fixed thereto, which members are also referred to as cutter teeth. The hydraulic motors are connected by hydraulic hoses to two hydraulic junction boxes 20 fixed on the top portion of said plate 14, symmetrically about the center of the plate. These hoses and junction boxes 20 form part of the means for powering said motor assembly 12. Specifically, the power used in this case is hydraulic pressure.

On its top portion, the plate 14 includes means for securing the motor assembly 12 to the bottom end of the structure. These means are constituted by two pegs in the form of cylindrical metal studs 22 fixed securely to the plate 14 symmetrically about the center of the plate 14 and extending orthogonally relative thereto. The studs 22 also include through holes 24 passing horizontally through them, and conically-shaped top portions 26 to facilitate assembly in a manner described below.

A suction nozzle 28 for sucking up particles that have been cut away is fixed to the center of the bottom portion of the plate 14 between the motors. In order to connect the nozzle 28 to the suction pipe 30 as described in detail below, the plate 14 includes a cylindrical hole 32 in its center.

Figure 1:
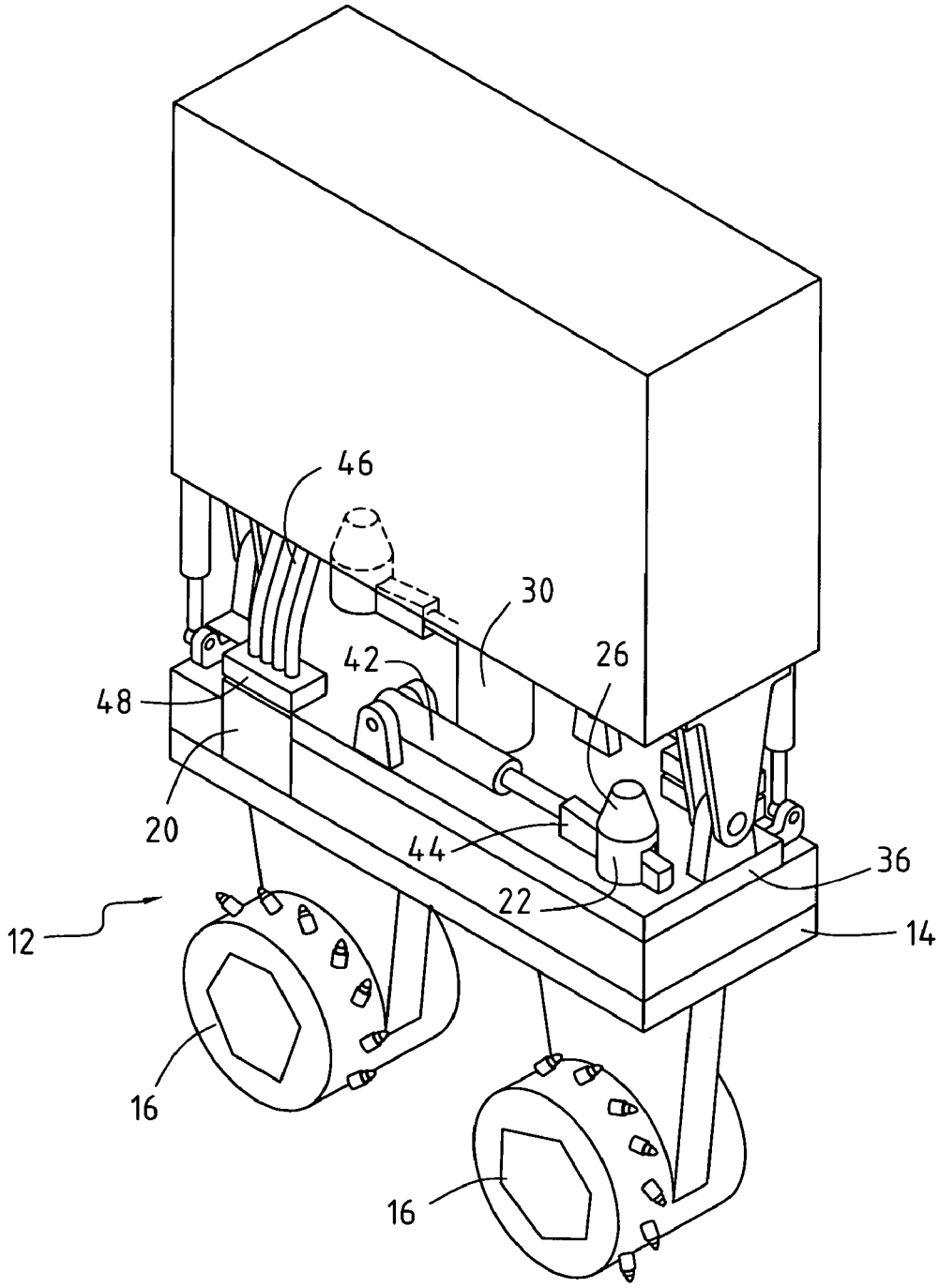
FIG. 1 is a perspective view of the cutter head fixed to the structure.

FIGS. 1 and 2 show the bottom portion of the structure 34. The bottom end of the structure 34 has a metal plate 36 fixed thereto so as to be tiltable relative to said structure and having substantially the same dimensions as the plate 14 that is associated with the cutter head 10. Tilting of the plate 36 is controlled by hydraulic actuators 38 fixed to said plate.

A suction pipe 30 is also fixed to run along the structure 34 in order to remove to the surface particles of rock that have been cut away. The bottom end of the pipe passes through the plate 26 in its center.

The plate 36 associated with the structure also has two cylindrical orifices 40 of diameter substantially equal to the diameter of the studs 22 that are fixed on the plate 14 associated wit the cutter head 10. These holes 40 are disposed symmetrically about the center of the plate 36 in such a manner as to receive the studs 22 when the two plates are positioned one on the other.

In the vicinity of the holes 40, there are fixed hydraulic actuators 42 on the top portion of the plate 36 associated with the structure. The ends of the rods of these actuators have metal cotter-pins 44 secured thereto of width significantly smaller than the width of the holes 24 in the studs 22 mentioned above, and extending lengthwise along axes XX'. The actuators 44 are positioned so as to be capable of moving the cotter-pins 44 along their axes XX' so that when in the actuated position the cotter-pins 44 overlie the holes 24 in the plate 36.

FIG. 1 shows the structure 34 and the cutter head 10 in the secured-together position, i.e. in the configuration that applies while excavating. In this configuration, the sides of the two plates are parallel in pairs, the studs 22 on the cutter head 10 are positioned in the holes 24 in the plate associated with the structure 36, and the cotter-pins 44 are positioned in the holes 24 through the studs 22 so as to prevent any relative movement between the two plates.

In order to feed the motors with hydraulic fluid, the hydraulic hoses 46 coming from a winder G situated on the surface (see FIG. 4), are fixed to the structure 34, and their bottom ends include couplings 48 for connecting with the junction boxes 20 situated on the plate 14 associated with the cutter head 10.

Still in this configuration, the bottom end of the suction pipe 30 comes into leaktight contact with the top end of the nozzle 28. Plane-on-plane contact between the two plates ensures that the suction member built up in this way is indeed leaktight.

It will be understood that in this configuration, the relative disposition of the end of the structure 34, of the cutter head 10, of the hydraulic fluid feed means, and of the removal means provides a device that is capable of performing the same functions as a cutting tool that is not suitable for being taken apart.

Nevertheless, completely removing the cutter head 10 makes changing tool very quick. In addition, in the embodiment described, the parts are separated by actuating actuators, which makes this operation much easier.

Naturally, it would not go beyond the ambit of the invention if the motor assembly were to be constituted by a motor and by a rotary torque transmission unit such as a gearbox, with the motor remaining secured to the structure and with the torque transmission unit being separable together with the cutter members.

Furthermore, it would not go beyond the ambit of the invention for the motor to be an electric motor and for the power supply means to be electric cables.

Figure 4:
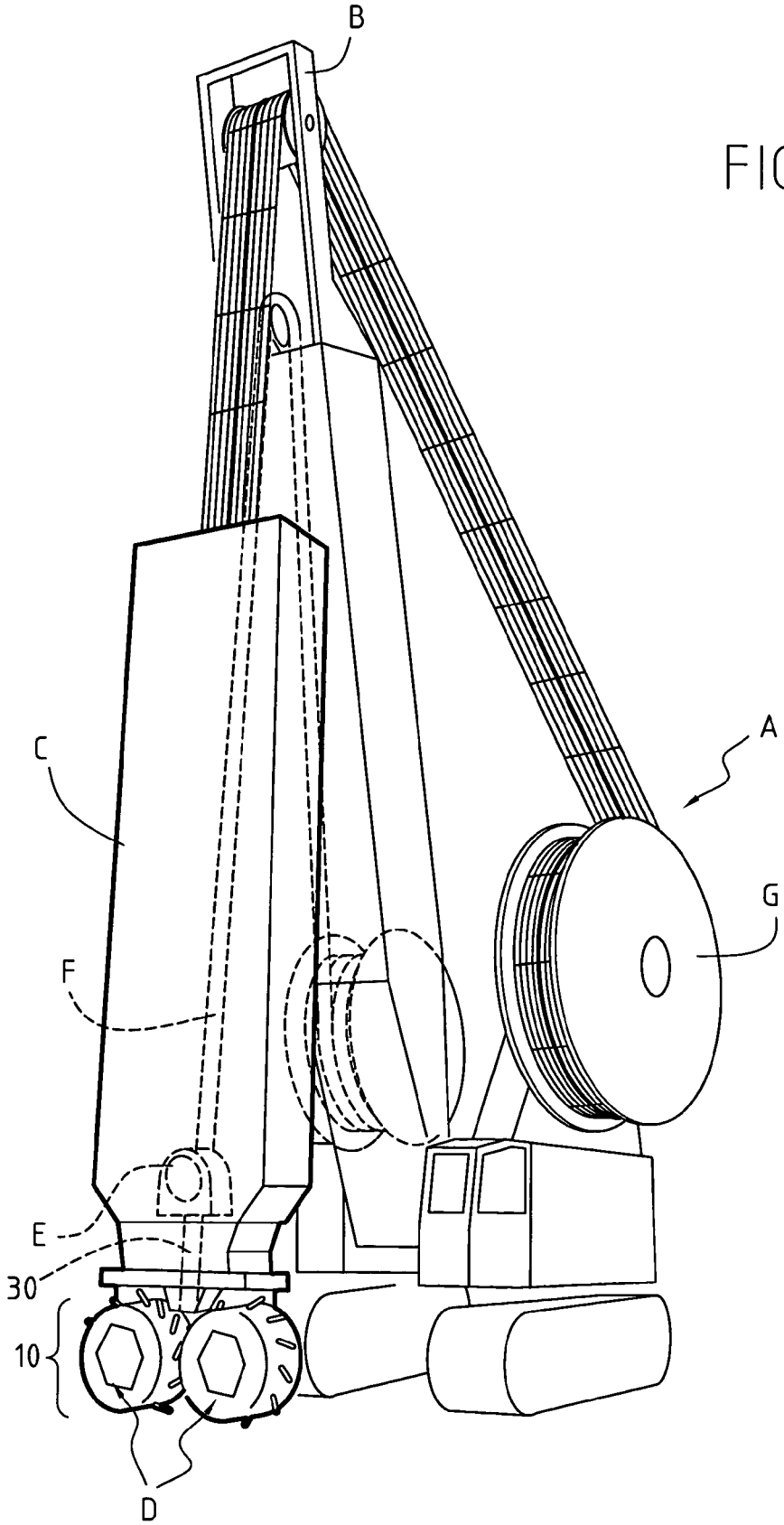
FIG. 4 is an overall view of the cutter tool.

The cutter head 10 can be mounted on a cutter tool as shown in FIG. 4 for digging trenches that are substantially vertical in order to make cast walls, preferably to great depth, e.g. at least 20 meters.

The cutter tool comprises a tracked vehicle A fitted with a jib B having a cutting structure C suspended therefrom by a cable. Two pairs of cutter wheels D having horizontal axes and driven by hydraulic motors are disposed at the bottom end of the cutter structure C. The cutter wheels are fitted with teeth that are distributed around their peripheries for the purpose of digging into the ground.

A hydraulic pump E is also installed in this portion of the structure C above the cutter wheel. This pump enables the particles that are cut away by the cutters to be sucked up in order to be removed to the surface via a removal pipe F.

The invention claimed is:

1. A cutting tool for digging vertical trenches, the tool comprising:

a jib;

a cutter structure suspended from the jib via a cable, said cutter structure extending along a vertical direction between an upper end connected to said jib and a bottom end;

a motor assembly;

at least one cutter wheel having a horizontal axis and driven by the motor assembly;

a power supply for powering said motor assembly;

releasable retention means for securing at least a portion of the motor assembly having the cutter members mounted thereto to the bottom end of the structure;

relative positioning means between the structure and the motor assembly; and means for connecting the power supply to the motor assembly;

wherein at least a portion of the motor assembly with the cutter members can easily be separated from the structure of the machine.

2. A cutting tool according to claim 1, wherein the motor assembly is a motor secured to the structure via the releasable retention means.

3. A cutting tool according to claim 2, wherein the motor is a hydraulic motor.

4. A cutting tool according to claim 1, wherein the power supply comprises hydraulic hoses.

5. A cutting tool according to claim 1, further comprising suction means secured to the structure, a separable suction nozzle associated with at least the portion of the motor assembly having the cutter members fixed thereon, and means for releasably connecting these two elements.

6. A cutting tool according to claim 1, wherein the means for connecting the power supply to the motor assembly comprise junction boxes.

7. A cutting tool according to claim 1, wherein in that the releasable retention means include a first plate having at least the portion of the motor assembly that supports the cutter members mounted on a bottom face thereof.

8. A cutting tool according to claim 7, wherein the bottom end of the structure further includes a second plate which comes to bear on the first plate associated at least with said portion of the motor assembly that supports the cutter members.

9. A cutting tool according to claim 7, wherein the relative positioning means and the retention means between the structure and at least a portion of the motor assembly comprise at least one fixing peg secured to the first plate associated with at least the portion of the motor assembly that supports the cutter members.

10. A cutting tool according to claim 7, wherein the relative positioning means and the retention means between the structure and at least a portion of the motor assembly comprise two fixing pegs secured to the first plate associated at least with the portion of the motor assembly that supports the cutter members.

11. A cutting tool according to claim 8, wherein the relative positioning means between the structure and at least the portion of the motor assembly which supports the cutter members includes at least one orifice situated in the plate associated with the structure and designed to receive a fixing peg.

12. A cutting tool according to claim 9, wherein the fixing peg includes a through orifice for receiving a locking member mounted on the structure.

13. A cutting tool according to claim 12, wherein the locking member is actuated by drive means.

14. A cutting tool according to claim 13, wherein the drive means comprise at least one actuator.

15. A cutting tool according to claim 12, wherein the locking member is a cotter-pin.

16. A cutting tool according to claim 7, wherein the second plate is connected to the bottom end of the structure by a pivot system.

17. A cutting tool according to claim 16, wherein the pivot system comprises hydraulic actuators.

18. A cutting tool for digging vertical trenches, the tool comprising:

a jib;

a cutter structure suspended from the jib via a cable;

a plurality of cutter members disposed on at least one cylindrical surface;

a motor assembly;

a power supply for powering said motor assembly;

releasable retention means for securing at least a portion of the motor assembly having the cutter members mounted thereto to a bottom end of the structure;

relative positioning means between the structure and the motor assembly; and means for connecting the power supply to the motor assembly;

suction means secured to the structure, a separable suction nozzle associated with at least the portion of the motor assembly having the cutter members fixed thereon, and means for releasably connecting these two elements;

wherein at least a portion of the motor assembly with the cutter members can easily be separated from the structure of the machine.

19. A cutting tool according to claim 18, wherein the motor assembly is a motor secured to the structure via the releasable retention means.

20. A cutting tool according to claim 18, wherein the power supply comprises hydraulic hoses.

21. A cutting tool according to claim 18, wherein the releasable retention means include a first plate having at least the portion of the motor assembly that supports the cutter members mounted on a bottom face thereof.

22. A cutting tool according to claim 21, wherein the bottom end of the structure further includes a second plate which comes to bear on the first plate associated at least with said portion of the motor assembly that supports the cutter members.

23. A cutting tool for digging vertical trenches, the tool comprising:

a jib;

a cutter structure suspended from the jib via a cable;

a plurality of cutter members disposed on at least one cylindrical surface;

a motor assembly;

a power supply for powering said motor assembly;

releasable retention means for securing at least a portion of the motor assembly having the cutter members mounted thereto to a bottom end of the structure;

relative positioning means between the structure and the motor assembly; and means for connecting the power supply means to the motor assembly;

wherein the releasable retention means include a first plate having at least the portion of the motor assembly that supports the cutter members mounted on the bottom face thereof; and wherein the bottom end of the structure further includes a second plate which comes to bear on the first plate associated at least with said portion of the motor assembly that supports the cutter members;

wherein at least a portion of the motor assembly with the cutter members is easily separated from the structure of the machine.

24. A cutting tool according to claim 23, wherein the relative positioning means and the retention means between the structure and at least a portion of the motor assembly comprise at least one fixing peg secured to the first plate associated with at least the portion of the motor assembly that supports the cutter members.

25. A cutting tool according to claim 23, wherein the relative positioning means between the structure and at least the portion of the motor assembly which supports the cutter members includes at least one orifice situated in the second plate associated with the structure and designed to receive a fixing peg.

* * * * *